US005807815A

United States Patent [19]

Alexander

[11] Patent Number: 5,807,815

[45] Date of Patent: Sep. 15, 1998

[54] AUTOMATIC TRANSMISSION FLUID HAVING LOW BROOKFIELD VISCOSITY AND HIGH SHEAR STABILITY

[75] Inventor: Albert Gordon Alexander, Sarnia, Canada

[73] Assignee: Exxon Research and Engineering Company, Florham Park, N.J.

[21] Appl. No.: 888,206

[22] Filed: Jul. 3, 1997

[51] Int. Cl.[6] ..... C10M 145/14

[52] U.S. Cl. ..... 508/469; 508/470

[58] Field of Search ..... 508/469, 470

[56] References Cited

U.S. PATENT DOCUMENTS

| | | | |
|---|---|---|---|
| 3,304,260 | 2/1967 | Fields et al. | 508/469 |
| 4,036,766 | 7/1977 | Yamamoto et al. | 252/51.5 A |
| 4,036,768 | 7/1977 | Crawford et al. | 252/51.5 A |
| 4,606,834 | 8/1986 | Hart et al. | 252/51.5 A |
| 4,668,412 | 5/1987 | Hart et al. | 252/51.5 A |
| 4,699,723 | 10/1987 | Kapuscinski et al. | 252/47 |
| 4,758,364 | 7/1988 | Seki et al. | 508/469 |
| 4,767,553 | 8/1988 | Hart et al. | 252/47.5 |
| 4,790,948 | 12/1988 | Liu et al. | 252/47.5 |
| 4,795,577 | 1/1989 | Hart et al. | 252/51.5 R |
| 4,812,261 | 3/1989 | Liu et al. | 252/51.5 A |
| 4,822,508 | 4/1989 | Pennewiss et al. | 252/56 R |
| 4,863,623 | 9/1989 | Nalesnik | 252/50 |
| 4,904,404 | 2/1990 | Liu et al. | 252/51.5 A |
| 4,957,650 | 9/1990 | Rossi et al. | 252/51.5 A |
| 4,968,444 | 11/1990 | Knoell et al. | 252/56 R |
| 4,986,924 | 1/1991 | Germanaud et al. | 252/51.5 A |
| 5,013,468 | 5/1991 | Benfaremo | 252/47.5 |
| 5,013,470 | 5/1991 | Benfaremo | 252/47.5 |
| 5,520,832 | 5/1996 | Alexander | 508/469 |
| 5,622,924 | 4/1997 | Sakai et al. | 508/469 |
| 5,641,732 | 6/1997 | Bloch et al. | 508/469 |
| 5,641,733 | 6/1997 | Bloch et al. | 508/469 |
| 5,646,099 | 7/1997 | Watts et al. | 308/469 |

FOREIGN PATENT DOCUMENTS

| | | | |
|---|---|---|---|
| 0393899A2 | 10/1990 | European Pat. Off. | C08F 265/04 |
| 0436872B1 | 7/1991 | European Pat. Off. | C10M 169/04 |
| 0439254A2 | 7/1991 | European Pat. Off. | C08F 220/18 |
| 0686690A1 | 12/1995 | European Pat. Off. | C10M 161/00 |
| 7292377 | 7/1995 | Japan | C10M 145/00 |
| 7286189 | 10/1995 | Japan | C10M 157/10 |
| 853683 | 2/1996 | Japan | C10M 145/14 |
| 853687 | 2/1996 | Japan | C10M 169/04 |
| 853688 | 2/1996 | Japan | C10M 169/04 |
| 8157855 | 6/1996 | Japan | C10M 169/04 |
| 8183988 | 7/1996 | Japan | C10M 169/04 |

*Primary Examiner*—Jacqueline V. Howard
*Attorney, Agent, or Firm*—Joseph J. Allocca

[57] ABSTRACT

An automatic transmission fluid of low Brookfield viscosity and high shear stability is disclosed which contains a base oil of lubricating viscosity and a combination of a poly alkyl (meth) acrylate viscosity index improver of low Brookfield viscosity and high shear stability and a functionalized poly alkyl (meth) acrylate viscosity index improver with dispersant properties of high Brookfield viscosity and high shear stability.

12 Claims, 4 Drawing Sheets

AUTOMATIC TRANSMISSION FLUID HAVING LOW BROOKFIELD VISCOSITY AND HIGH SHEAR STABILITY

BACKGROUND OF THE INVENTION

1. Field of the Invention

The present invention relates to an automatic transmission fluid possessing the desirable characteristic of low Brookfield viscosity and high shear stability.

2. Description of the Art

Automatic transmissions are generally accepted as the most complex and costly component of an automobile. They are used in over 90% of all vehicles in North America and their use is becoming more commonplace in other parts of the world. Due to the complexity of automatic transmissions, automotive manufacturers often find that they constitute the largest warranty item for new vehicles. Thus the major OEMs have developed stringent specifications and controls on all components that go into an automatic transmission, one of the most important being the automatic transmission fluid (ATF).

An automatic transmission comprises a torque converter, planetary gears, output drives and the hydraulic system. Viscometrics is the single most important lubricant parameter that governs the successful operation of the transmission. In particular, low temperature characteristics and shear stability requirements are becoming more important.

Good low temperature characteristics are required as the automatic transmission become more sophisticated in terms of their hydraulic and electronic controls. Good low temperature characteristics are also important in achieving improved cold environmental operation, improved fuel economy, and reduced transmission wear.

High shear stability is required if the fluid is to maintain proper kinematic viscosity to ensure stable torque converter and hydraulic performance and to ensure the fluid provides good load carrying/wear protection performance over the life of the fluid fill in the transmission as well as extending the useful life of the fluid in service.

The key low temperature test parameter is Brookfield viscosity, ASTM D 2983, and the maximum limit required by General Motors, Ford and Chrysler is 20,000 cP at −40° C.

The shear stability of a lubricant can be measured in various tests, such as the Kurt Orbahn diesel injector (ASTM D 3945) and the KRL tapered rolling hearing (CEC L-45-T-93).

Numerous automatic transmission fluids are described in the literature.

U.S. Pat. No. 4,758,364 describes a lube oil composition suitable for automatic transmissions comprising a lube oil of lubricating viscosity in the range 1.5–5.0 cSt @ 100° C. and (1) a polymer selected from the group consisting of polypropylene, polyisobutylene and a copolymer of 1-butane and isobutylene, said polymer having a mol weight of 2,000–3,000, (2) at least one copolymer having an average mol weight of 10,000–30,000 which is selected from the group consisting of copolymers (a) of two or more meth-acrylic acid esters of the formula

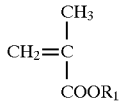

wherein $R_1$ is a $C_1$–$C_{18}$ alkyl and copolymers (b) which is at least one meth-acrylic acid ester of formula

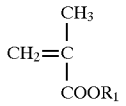

and one or more nitrogen containing monomers of the formula

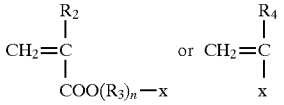

wherein $R_2$ and $R_4$ are H, $CH_3$, $R_3$ is $C_2$–$C_{18}$ alkylene n is 0 or 1 and x is an amine moiety or a heterocyclic moiety containing 1 or 2 nitrogen atoms and 0 to 2 oxygen atoms, said homopolymer or copolymer (1) being present in an amount of 5–12 wt % and said copolymer (2) being present in an amount of 1–5 wt %.

EP 436872 claims a hydraulic fluid for automatic transmissions based on mineral oil containing 80 to 90 parts by weight of a paraffin based raffinate of about 4 $mm^2/s$ viscosity at 100° C., 2 to 10 parts by weight of ATF additives such as flow improvers, anti oxidants, anti wear agents, non dispersant polyisobutylene additives, and 2 to 15 parts by weight of copolymer of (a) at least one $C_1$ to $C_{30}$ alkyl ester of methacrylic acid and/or acrylic acid and (b) at least one monomer with polar, oxygen and/or nitrogen atom containing functional groups and which are synthesized from the comonomers (a) and (b) in a molar-ratio a:b of 1:0.01 to 0.2 and have a mol weight of 5,000 to 200,000, wherein the ATF so formulated has a Brookfield viscosity below 30,000 to below 20,000 m Pas at −40° C.

U.S. Pat. No. 4,968,444 claims additives for n-paraffin containing lube oils which additive comprises 20 to 40 wt % of a solvent, the balance being a mixture comprising a first polymer which is at least binary which is defined, broadly, as a wide class of poly alkyl (meth) acrylates and include polymers containing acrylate monomers containing functional groups, e.g., groups containing oxygen or nitrogen, and a second polymer which is similarly broadly defined as a wide class of poly alkyl (meth) acrylate which similarly may include poly alkyl (meth) acrylate which are substituted with oxygen or nitrogen containing functional groups.

JP 08183988 discloses a viscosity index improver comprising alkyl acrylate polymer(s) having 1–20 carbon alkyl groups and alkyl methacrylate polymers having 1–20 carbon alkyl groups. Lubricating oil formulations such as automatic transmission fluids containing such viscosity index improvers are also disclosed.

JP 07292377 discloses an additive for lube oils consisting of a polymer which contains 80–99.5 wt % of (a) $C_1$–$C_{10}$ alkyl acrylate and 0.5 to 20 wt % of a (meth) acrylate acid ester of the alkylene oxide adduct of saturated and/or unsaturated aliphatic mono alcohol. Also disclosed are automatic transmission fluids containing such additive.

JP 07286189 discloses an additive consisting of a polymer (A) which contains (a-1) 70–99.5 wt % of (1) a $C_{10}$ or lower alkyl (meth) acrylate and (a-2) 0.5 to 30 wt % of one or more compounds selected from N-vinyl pyrroli-done, N,N dialkylamino alkyl (meth) acrylate with $C_1$–$C_4$ alkyl groups, N dialkyl amino alkyl (meth) acrylate, vinyl pyrrolidene, morphorine ethyl meth-acylate and vinyl imidozole. The additive may also contain (B) a pour depressant.

U.S. Pat. No. 5,622,924 discloses a viscosity index improver comprising a polymer containing at least 70 wt % of an alkyl (meth) acrylate monomer having alkyl groups of 10 carbons or less. Also disclosed are drive train lubricants containing the additive. The additive is described as optionally containing not more than 30% by weight of structural units of at least one monomer having at least one atom selected from nitrogen, oxygen and sulfur, said monomer being introduced into the polymer by copolymerization, graft copolymerization or graft addition. The presence of such heteroatom monomer in the additive is generally described as impacting detergency and/or dispersancy to the additive.

BRIEF DESCRIPTION OF THE INVENTION

Figure 1A:
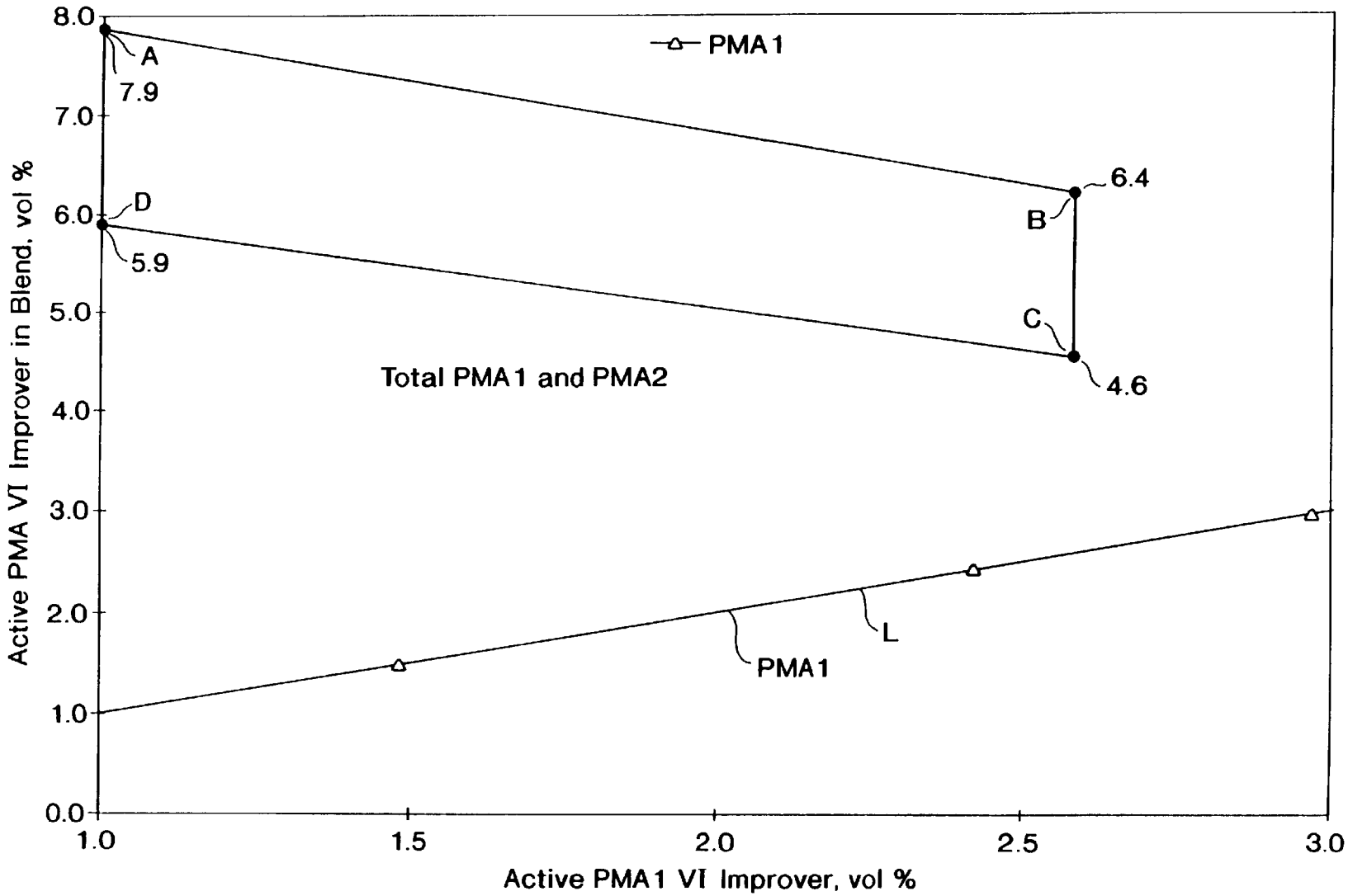
FIGS. 1A, 1B and 1C present the relationship between the broad, preferred and most preferred range of total amount of mixture of polyalkyl (meth) acrylate additives present in the base stock and the broad, preferred and most preferred amount of finctionalized poly alkyl (meth) acrylate present in the mixture.
Figure 1B:
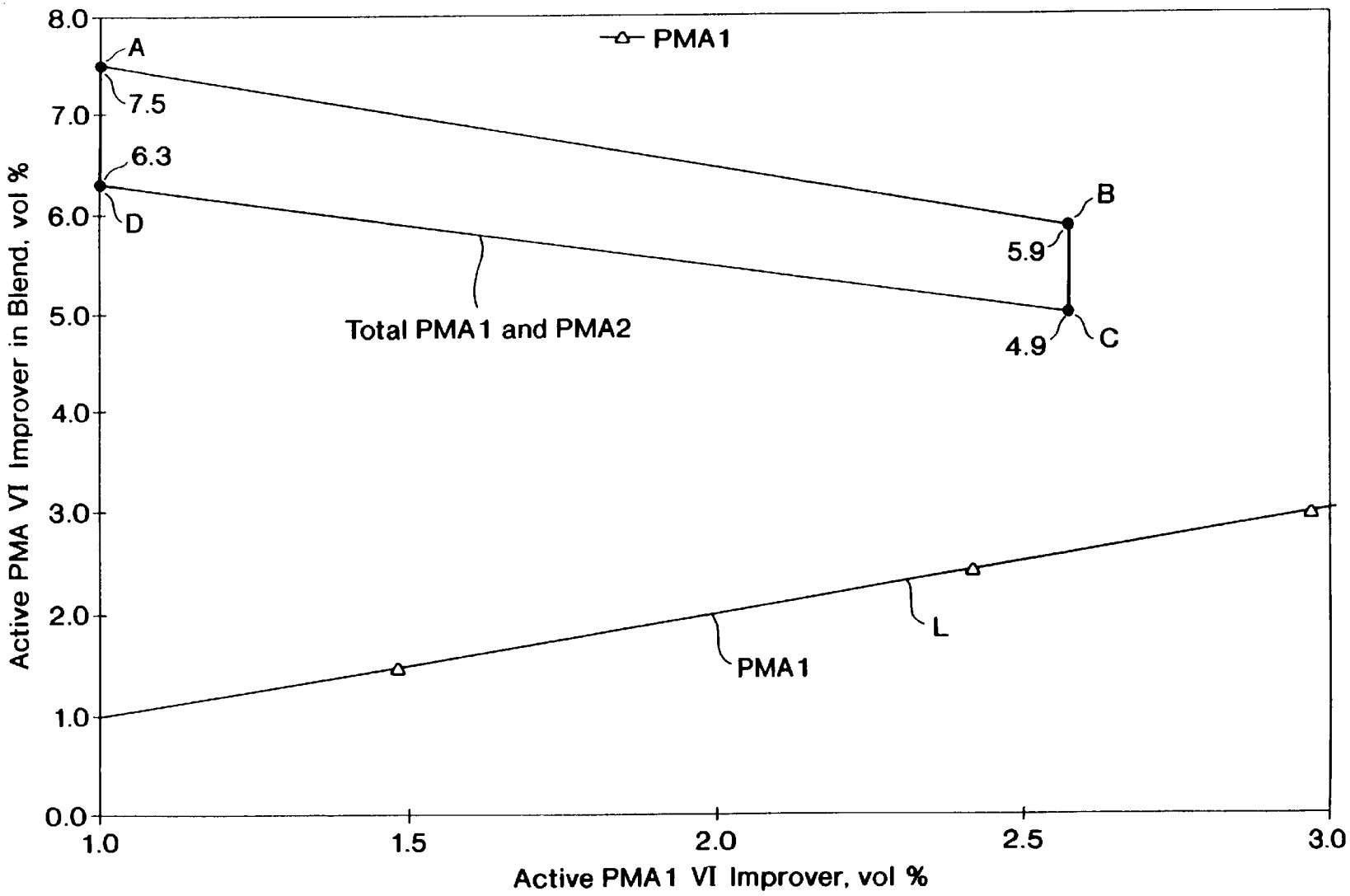
Figure 1C:
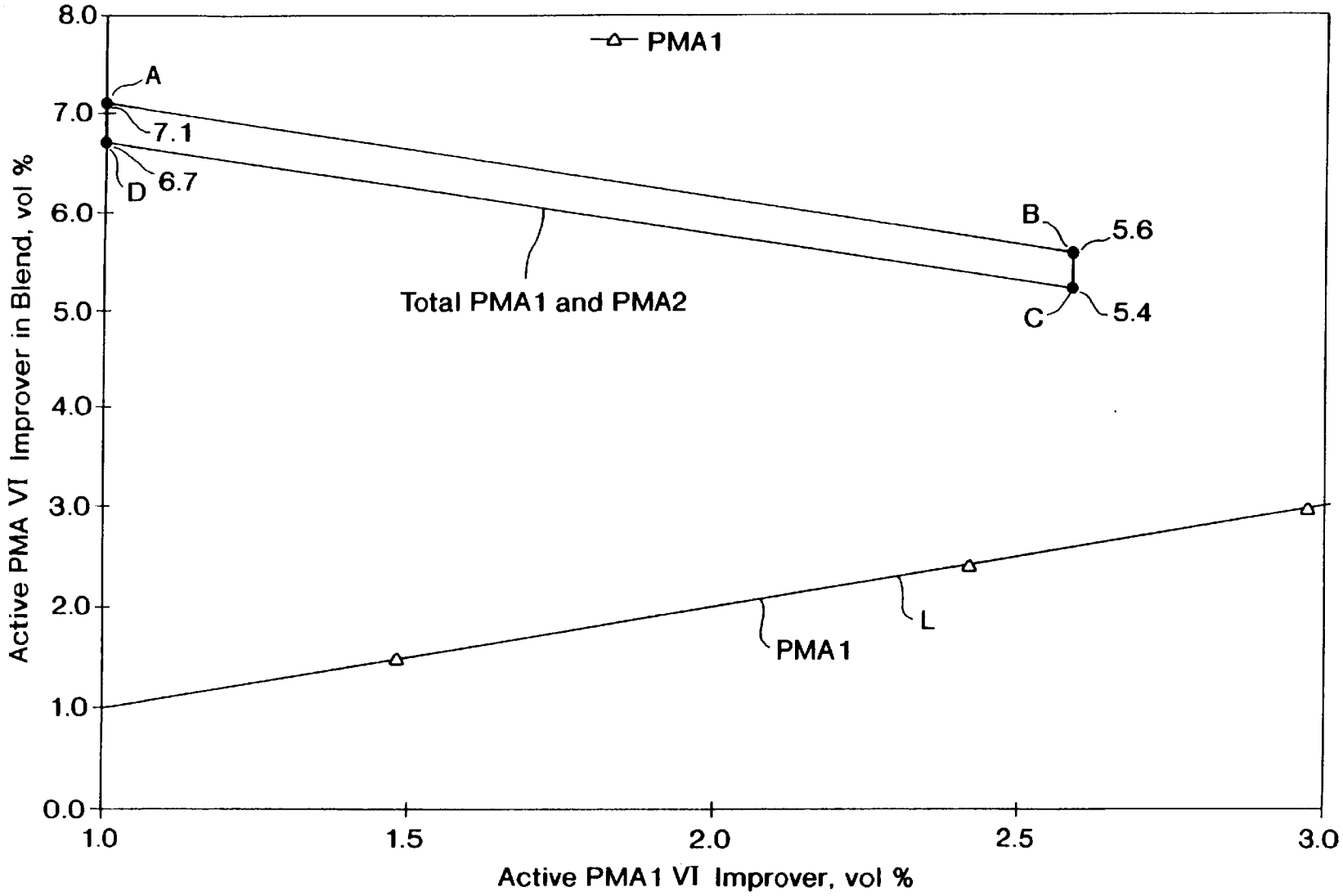

The present invention relates to an automatic transmission fluid possessing the dual desirable properties of low Brookfield viscosity, about 50,000 cP or lower @ −40° C. preferably about 30,000 cP or lower at −40° C., most preferably about 25,000 cP or lower at −40° C., and high shear stability, comprising a lubricating oil base stock suitable for use as an automatic transmission fluid base stock and an additive comprising a mixture of a first, functionalized poly alkyl (meth) acrylate (PMA-1) viscosity index improver possessing dispersant properties and a second polyalkyl (meth) acrylate viscosity index improver (PMA-2). The total amount of said first and second poly alkyl (meth) acrylates in the formulation, on an active ingredient basis, is presented as the area bounded by ABCD in Figures 1*a*, 1*b* and 1*c* where the y axis represent the total amount (in vol %) of the mixture of PMA-1 and PMA-2 (active ingredient) in the automatic transmission fluid, and the amount of PMA-1 (active ingredient in vol %) present in the mixture is determined by reference to line L and read off the x axis. The amount of ingredient PMA-2 present in any mixture, therefore, can be readily determined by reading the total amount of PMA-1 and PMA-2 additive in the mixture in the area bounded by ABCD from the y axis and subtracting from it the amount of PMA-1 shown on line L from the x axis which can be present in the mixture.

THE PRESENT INVENTION

The present invention is an automatic transmission fluid of exceptional shear stability and low Brookfield viscosity @ −40° C.

The fluid possesses a Brookfield viscosity @ −40° C. of about 50,000 cP or less, preferably about 30,000 cP or less, most preferably about 25,000 cP or less and a stability index of about 10 or less and preferably about 5 or less.

The automatic transmission fluid comprises a major amount, that is, typically about 70–92 vol %, more usually about 80 to 90 vol % of a lubricating oil base stock of lubricating viscosity suitable for use as an automatic transmission fluid. Said base stock can be derived from any material paraffinic or naphthenic crude service suitably processed as by distillation, hydroprocessing, hydrocracking, solvent extraction, solvent and/or catalytic dewaxing, or suitable synthetic hydrocarbon such as polyalpha olefin made by the oligomerization of at least 1 alkene having in the range of 6 to 20, preferably 8 to 16 more preferably 10 to 12 carbons or polyol ester made by the esterification of aliphatic polyol with carboxylic acids, said aliphatic polyols containing from 4 to 15 carbons and having from 2 to 8 esterifiable hydroxyl group, e.g., trimethylolpropane, pentaerythritol, dipentaerythritol, neopentyl glycol, tripentaerythritol and mixtures thereof, and said carboxylic acids being mono carboxylic acid or mixture of mono and dicarboxylic acids having from 4 to 12 carbon atoms and including straight or branched chain acids and mixtures of such acids.

Regardless of source, the automatic transmission base stock will be one having a viscosity of about 10 to 30 $mm^2/s$ @ 40° C. preferably 12 to 25 $mm^2/s$ @ 40° C.

The automatic transmission fluid, in addition to containing the base stock contains a minor amount of additive comprising a first fuctionalized poly alkyl (meth) acrylate viscosity index improver possessing dispersant properties and a second polyalkyl (meth) acrylate viscosity index improver.

The first poly alkyl (meth) acrylate viscosity index improver with dispersant properties due to functionalization has a weight average molecular weight of about 125,000 to about 225,000, preferably about 150,000 to 200,000 by Gel Permeation Chromatography and a shear stability index of about 15 or less, preferably about 8 or less.

This first polyalkyl (meth) acrylate is functionalized with nitrogen containing groups suitable for imparting dispersant properties to the additive and have a basic nitrogen content of between about .1 to .2% basic nitrogen.

This first, functionalized poly alkyl (meth) acrylate possess Brookfield viscosities @ −40° C. of between about 200,000 to 600,000 cP, preferably 275,000 to 475,000 cP as determined for a mixture of the functionalized poly alkyl (meth) acrylate in a hydroprocessed mineral oil having a kinematic viscosity in the range 17.0–19.0 $mm^2/s$ @ 40° C. and 3.78–3.94 $mm^2/s$ @ 100° C. and having a pour point of 1 8° C. maximum containing sufficient poly alkyl meth acrylate so as to achieve an equivalent fresh oil kinematic viscosity of about 7 to 8 $mm^2/s$ @ 100°C., preferably 7.2–7.7 $mm^2s$ @ 100° C.

Representative of a commercially available functionalized poly alkyl (meth) acrylate meeting these requirements and suitable for use in the present invention is Acryloid 1267 from RohMax (formerly Rohm & Haas). Acyloid 1267 is reported by the manufacturer as having a basic nitrogen content of about 0.16%, a bulk viscosity of about 700 and was found to have a weight average molecular weight of about 175,000 (as determined by General Permeation Chromatography) and a shear stability index of about 5.

The second poly alkyl (meth) acrylate viscosity index improver is a poly alkyl (meth) acrylate having a weight average molecular weight in the range 50,000 to 150,000, preferably 75,000 to 125,000 as measured by Gel Permeating Chromatography and a shear stability index of about 10 or less, preferably about 5 or less. Such materials are commercially available. Acryloid 4115 (formerly Acryloid 1019) or Acryloid 1017 from RohMax (formerly Rohm & Haas) are examples of such poly alkyl (meth) acrylate.

Another important characteristic of this second polyalkyl (meth) acrylate is its Brookfield viscosity @ −40° C. These second poly alkyl (meth) acrylates have Brookfield viscosities @ −40° C. of between about 10,000 to 30,000 cP, preferably about 12,000 to 25,000 cP as determined for a mixture of poly alkyl meth-acrylate in a hydroprocessed mineral oil having a kinematic viscosity in the range 17.0–19.0 $mm^2/s$ @ 40° C. and 3.78–3.94 $mm^2/s$ @ 100° C. and having a pour point of 18° C. maximum wherein the poly alkyl meth acrylate is present in the hydroprocessed oil an amount sufficient to achieve equivalent fresh oil kinematic viscosity of about 7 to 8 $mm^2/s$ @ 100° C., preferably 7.2–7.7 $mm^2/s$ @ 100 ° C.

The shear stability properties of VI improvers are commonly expressed in terms of Shear Stability Index (SSI).

Shear Stability Index (SSI) is a measure of the tendency of polymeric VI improvers to degrade and lose their ability to thicken and maintain viscosity, when subjected to shearing. Shearing can occur in pumps, gears, engines, etc.

The SSI is constant for any given polymer, and the equation used to calculate SSI is given below. It can be seen that the after shear viscosity is proportional to the SSI.

$$SSI = \frac{\mu_i - \mu_f}{\mu_i - \mu_o} \times 100$$

where $\mu_i$=initial oil viscosity in cSt at 100° C.

$\mu_f$=final oil viscosity after test in cSt at 100° C.

$\mu_o$=viscosity of base oil blend in cSt at 100° C. with all additives except the VI improver The SSI value is nearly constant for each polymer under a given set of operating conditions. However, SSI values do vary with the severity of service. SSI thus provides a convenient method for estimating viscosity loss under a known set of operating conditions.

If more than one polymer is present, the same equation would apply to each VI improver, although the SSI could be different. That is, there would be a family of equations, one for each VI improver.

Since no chemical reaction would be expected from the blend of VI improvers, the total shear loss of the fluid would comprise the contribution of each VI improver, in the ratio of their concentrations and SSI.

In addition to the mixture of poly alkyl (meth) acrylates discussed above, automatic transmission fluids also contain other ingredients such as corrosion inhibitors, oxidation inhibitors, friction modifiers, demulsifiers, anti foamant, anti wear agents, pour point depressants and seal swellants said additional materials being present in the finished ATF in total concentration of 5 to 15 vol %, preferably 5–10 vol %.

Corrosion inhibitors, also known as anti-corrosive agents, reduce the degradation of the metallic parts contained by the ATF. Illustrative of corrosion inhibitors are zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt % of a sulfide of phosphorous for 1/2 to 15 hours, at a temperature in the range of 150° F. to 600° F. Neutralization of the phosphosulfurized hydrocarbon may be effected in the manner taught in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenol thioesters having preferably $C_5$ to $C_{12}$ alkyl side chains, e.g., calcium nonylphenol sulfide, barium t-octylphenol sulfide, zinc dialkyldithiophosphates, dioctylphenylamine, phenylalphanaphthylamine, phosphosulfurized or sulfurized hydrocarbons, etc.

Dispersants maintain oil insolubles, resulting from oxidation during use, in suspension in ATF thus preventing sludge flocculation and precipitation. Suitable dispersants include high molecular weight alkyl succinates, the reaction product of oil-soluble polyisobutylene succinic anhydride with ethylene amines such as tetraethylene pentamine and borated salts thereof.

Pour point depressants lower the temperature at which the ATF will flow or can be poured. Such depressants are well known. Typical of those additives which usefully optimize the low temperature fluidity of the ATF are $C_8$–$C_{18}$ dialkylfumarate vinyl acetate copolymers, polymethacrylates ($C_{12}$ to $C_{18}$ alkyl), and wax naphthalene condensation products.

Foam control is provided by an anti-foamant of the polysiloxane type, e.g., silicone oil and polydimethyl siloxane.

Anti-wear agents, as their name implies, reduce wear of transmission parts. Representative of suitable antiwear agents are zinc dialkyldithiophosphate, zinc diaryldilhiophosphate and magnesium sulfonate.

Some of these numerous additives can provide a multiplicity of effects, e.g., a dispersant-oxidation inhibitor. This approach is well known and need not be further elaborated herein.

Seal swellants include mineral oils of the type that provoke swelling and aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 ester linkages, e.g., dihexylphthalate, as are described in U.S. Pat. No. 3,974,081.

By practice of the present invention it has been found possible to produce an ATF exhibiting good Brookfield viscosity and possessing high shear stability by employing two poly alkyl (meth) acrylate polymer, one exhibiting good Brookfield viscosity and high shear stability and the other exhibiting poor Brookfield viscosity but high shear stability, it being unexpectedly found that the mixture of the two different poly alkyl methacrylate polymers acts synergistically in that the resultant Brookfield viscosity of the ATF containing the mixture is lower than the arithmetic mean one would have expected from simply blending of the two materials in the base stock. This unexpectedly permits the practitioner to employ a wider range of more readily available and possibly cheaper materials to achieve a desired result, as compared to having to use two polyalkyl meth acrylate both of which, previously, would have had to possess both low Brookfield viscosity and high shear stability. The present invention constitutes an unexpected new route to the formulation of automatic transmission fluids of high shear stability and low Brookfield viscosity.

EXAMPLES

Example 1

A series of different poly alkyl (meth) acrylate in a hydroprocessed mineral oil stock having a kinematic viscosity in the range 17.0–19.0 $mm^2/s$ @ 40° C. and 3.78–3.94 $mm^2/s$ @ 100° C. and a pour point of 18° C. maximum was prepared for the purpose of ascertaining their physical properties. Enough of each different poly alkyl (meth) acrylate materials was added to the base stock to produce a product having a kinematic viscosity in the range of about 7.3 to 7.5 $mm^2/s$ @ 100° C. The polyalkyl (meth) acrylates added to the base stock were secured from Rohm or Haas and are Acryloid 4115, an unfunctionalized poly alkyl (meth) acrylate, and three functionalized poly alkyl (meth) acrylates, Acryloid 1263, Acryloid 1265 and Acryloid 1267. The manufacturer literature reports that following material characteristics:

TABLE 1

| Material | Mol Wt | SSI | Basic Nitrogen Content % |
|---|---|---|---|
| Acryloid 1263 | 750,000 | 45 | .12 |
| Acryloid 1265 | 500,000 | 27 | .14 |
| Acryloid 1267 | 175,000 | 5 | .16 |
| Acryloid 4115 | 100,000 | 1 | — |

The Brookfield viscosities in cP @ −40° C. for the materials was experimentally found to be as follows:

TABLE 2

| Components, v % | | | | |
|---|---|---|---|---|
| Base Stock* | 94.80 | 94.40 | 93.40 | 89.50 |
| Acryloid 1263 (as received) | 5.20 | — | — | — |
| Acryloid 1265 (as received) | — | 5.60 | — | — |
| Acryloid 1267 (as received) | — | — | 6.60 | — |
| Acryloid 4115 (as received) | — | — | — | 10.50 |
| Viscosity @ 100° C. | | | | |
| Before shear, cSt | 7.37 | 7.29 | 7.33 | 7.50 |
| After shear, cSt | 5.70 | 6.34 | 7.11 | 7.44 |
| SSI (calc) | 46 | 28 | 6 | 2 |
| Brookfield @ −40° C. | | | | |
| Run #1, cP | 20,400 | 46,800 | 293,200 | 16,920 |
| Run #2, cP | 22,100 | 60,800 | 463,000 | 16,780 |
| Average. cP | 21,250 | 53,800 | 376,100 | 16,850 |
| Acryloid 1263 (37% active) | 1.924 | — | — | — |
| Acryloid 1265 (55% active) | — | 3.08 | — | — |
| Acryloid 1267 (55% active) | — | — | 3.630 | — |
| Acryloid 4115 (71% active) | — | — | — | 7.455 |

*a hydroprocessed mineral oil having a kinematic viscosity in the range 17.0–19.0 $mm^2/s$ at 40° C. and a pour point of 18° C. maximum.

The Brookfield viscosity for the functionalized, dispersant poly alkyl (meth) acrylates varied from 21,250 cP to 378,100 cP. The Shear Stability Index (SSI) was determined using the Kurt Orbahn method (ASTM 3945), with values ranging from 48 to 6 (lower numbers signify that the fluid is more shear stable).

Example 2

Table 3 shows blend studies using various ratios of Acryloid 1267 and Acryloid 4115 in a finished ATF formulation. The other two functionalized poly alkyl (meth) acrylates were not tested because of their low shear stability. Fluids containing such components would have been expected to have degraded shear stability. Using 100% Acryloid 1267 gave a Brookfield of 774,000 cP, while 100% Acryloid 4115 gave a Brookfield of 14,320 cP. Addition of Acryloid 4115 to Acryloid 1267 has a synergistic effect on the finished fluid Brookfield, for example, a 50/50 blend of the two components gave a Brookfield of 25,775 cP.

Figure 2:
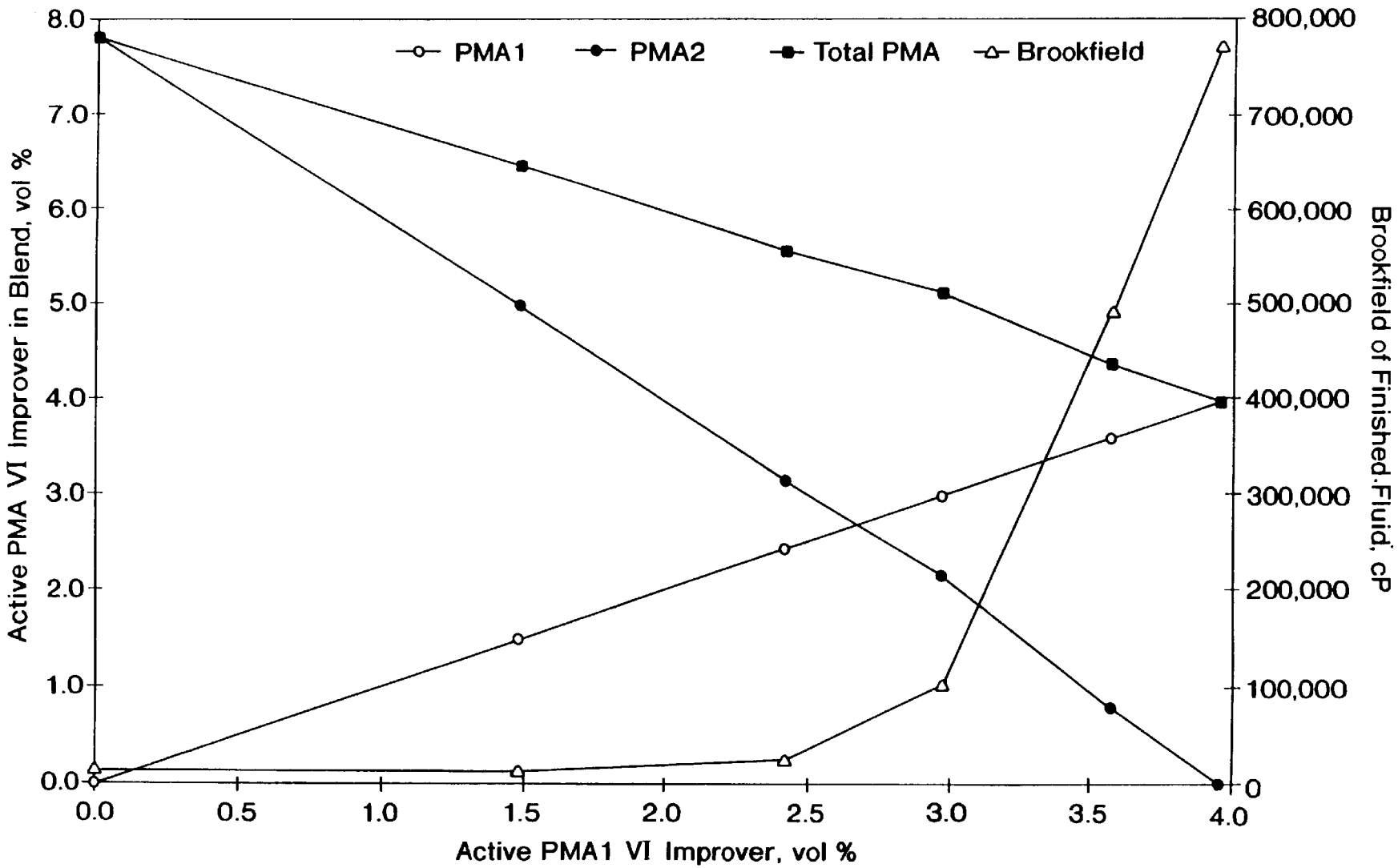
FIG. 2 presents the effect of functionalized poly alkyl (meth) acrylate on the Brookfield viscosity of a mineral oil base containing a mixture of functionalized poly alkyl (meth) acrylate and an unfunctionalized poly alkyl (meth) acrylate

The data in Table 3 is plotted in FIG. 2, where it can be seen that there is a step change relationship depending on the ratio of the two VI improvers with respect to the Brookfield viscosities of fluids containing mixtures of the two acrylates.

The DI package is a typical ATF package having an antiwear additive, detergent additive, antioxidant, anti rust, copper pacifier, friction modifiers, diluent oil to solubilize the mix and to enhance fluidity, etc.

TABLE 3

| Components, vol % | Batch Number Specifications | 1 | 2 | 3 | 4 | 5 | 6 |
|---|---|---|---|---|---|---|---|
| Components, v % | | | | | | | |
| Base Oil | | 84.375 | 83.975 | 83.175 | 82.775 | 81.875 | 80.575 |
| DI Package | | 8.400 | 8.400 | 8.400 | 8.400 | 8.400 | 8.400 |
| Acryloid 1267 (as received) | | 7.200 | 6.500 | 5.400 | 4.400 | 2.700 | 0.000 |
| Acryloid 4115 (as received) | | 0.000 | 1.100 | 3.000 | 4.400 | 7.000 | 11.000 |
| Automate Red B | | 0.025 | 0.025 | 0.025 | 0.025 | 0.025 | 0.025 |
| KV @ 100° C., cSt (Fresh oil, before shear) | 7.25 min | 7.760 | 7.701 | 7.852 | 7.761 | 7.760 | 7.741 |
| Brookfield @ −40° C. | 20,000 max | | | | | | |
| Run #1, cP | — | 787,000 | 488,000 | 99,200 | 24,400 | 13,580 | 14,340 |
| Run #2, cP | — | 761,000 | 496,000 | 107,000 | 27,150 | 14,140 | 14,300 |
| Average, cP | — | 774,000 | 492,000 | 103,100 | 25,775 | 13,860 | 14,320 |
| As received VII | | | | | | | |

TABLE 3-continued

| Components, vol % | Batch Number Specifications | 1 | 2 | 3 | 4 | 5 | 6 |
|---|---|---|---|---|---|---|---|
| Acryloid 1267 (as received) | — | 7.200 | 6.500 | 5.400 | 4.400 | 2.700 | 0.000 |
| Acryloid 4115 (as received) | — | 0.000 | 1.100 | 3.000 | 4.400 | 7.000 | 11.000 |
| Ratio Ac 1267/Ac 4115 | — | — | 5.909 | 1.800 | 1.000 | 0.386 | 0.000 |
| Percent Ac 1267 of Total VII | — | 100.000 | 85.526 | 64.286 | 50.000 | 27.835 | 0.000 |
| Percent Ac 4115 of Total VII | — | 0.000 | 14.474 | 35.714 | 50.000 | 72.615 | 100.000 |
| Active VII polymer | | | | | | | |
| Acryloid 1267 (55% active) | — | 3.960 | 3.575 | 2.970 | 2.420 | 1.485 | 0.000 |
| Acryloid 4115 (71% active) | — | 0.000 | 0.781 | 2.130 | 3.124 | 4.970 | 7.810 |
| Ratio Ac 1267/Ac 4115 | — | — | 4.577 | 1.394 | 0.775 | 0.299 | 0.000 |
| Percent Ac 1267 of Total VII | — | 100.000 | 82.071 | 58.235 | 43.651 | 23.005 | 0.000 |
| Percent Ac 4115 of Total VII | — | 0.000 | 17.929 | 41.765 | 56.349 | 76.995 | 100.000 |

What is claimed is:

1. An automatic transmission fluid having a Brookfield viscosity of about 50,000 cP or lower at −40° C., a shear stability index of about 10 or less comprising a base stock of suitable viscosity for use as an automatic transmission fluid base stock and a first functionalize poly alkyl (meth) acrylate viscosity index improver possessing dispersant properties having a weight average molecular weight of about 125,000 to 225,000, a shear stability index of 15 or less, a Brookfield viscosity at −40° C. of between about 200,000 to 600,000 cP as determined for a mixture of the functionalized poly alkyl (meth) acrylate in a hydroprocessed mineral oil having a kinematic viscosity in the range 17 to 19 $mm^2/s$ at 100° C. and having a pour point of 18° C. maximum wherein the functionalized poly alkyl (meth) acrylate is present in said mineral oil in an amount sufficient to achieve an equivalent fresh oil kinematic viscosity of about 7 to 8 $mm^2/s$ at 100° C., and a second poly alkyl (meth) acrylate viscosity index improver having a weight average molecular weight in the range 50,000 to 150,000, a shear stability index of about 10 or less, and a Brookfield viscosity at −40° C. of between about 10,000 to 30,000 cP, as determined for a mixture of said poly alkyl (meth) acrylate in the aforesaid hydroprocessed mineral oil wherein the poly alkyl (meth) acrylate is present in said oil in an amount sufficient to achieve an equivalent fresh oil kinematic viscosity of about 7 to 8 $mm^2/s$ at 100° C., the total amount of said first and second poly alkyl (meth) acrylate viscosity index improver in the fluid and the amount of the first poly alkyl (meth) acrylate present in the poly alkyl (meth) acrylate mixture being as presented in FIG. 1*a*.

2. The automatic transmission fluid of claim 1 wherein the total amount of said first and second poly alkyl (meth) acrylate) viscosity index improvers in the fluid and the amount of the first poly alkyl (meth) acrylate viscosity index improver present in the said mixture of poly alkyl (meth) acrylates is as presented in FIG. 1*b*.

3. The automatic transmission fluid of claim 1 wherein the total amount of said first and second poly alkyl (meth) acrylate viscosity index improver in the fluid and the amount of the first poly alkyl (meth) acrylate viscosity index improver present in said mixture of poly alkyl (meth) acrylates is as presented in FIG. 1*c*.

4. The automatic transmission fluid of claim 1, 2 or 3 wherein the first poly alkyl (meth) acrylate viscosity index improver has a weight average molecular weight of about 150,000 to 200,000, a shear stability index of about 8 or less, and a Brookfield viscosity of about 275,000 to 475,000 cP @ −40° C.

5. The automatic transmission fluid of claim 1, 2 or 3 wherein the second poly alkyl (meth) acrylate viscosity index improver has a weight average molecular weight of about 75,000 to 125,000, a shear stability index of about 5 or less, and a Brookfield viscosity of about 12,000 to 25,000 cP at −40° C.

6. The automatic transmission fluid of claim 4 wherein the second poly alkyl (meth) acrylate viscosity index improver has a weight average molecular weight of about 75,000 to 125,000, a shear stability index of about 5 or less, and a Brookfield viscosity of about 12,000 to 25,000 cP at −40° C.

7. A method for producing an automatic transmission fluid having a Brookfield viscosity of about 50,000 cP or lower at −40° C., and a shear stability index of about 10 or less comprising a base stock of suitable viscosity for use as an automatic transmission fluid base stock said method comprising adding to said base stock a first functionalized poly alkyl (meth) acrylate viscosity index improver possessing dispersant properties having a weight average molecular weight of about 125,000 to 225,000, a shear stability index of 15 or less, a Brookfield viscosity at −40° C. or between 200,000 to 600,000 cP as determined for a mixture of the functionalized poly alkyl (meth) acrylate in a hydroprocessed mineral oil having a kinematic viscosity in the range 17 to 19 $mm^2/s$ at 100° C. and having a pour point of 18° C. maximum wherein the functionalized poly alkyl (meth) acrylate is present in said mineral oil in an amount sufficient to achieve an equivalent fresh oil kinematic viscosity of about 7 to 8 $mm^2/s$ at 100° C., and a second poly alkyl (meth) acrylate viscosity index improver having a weight average molecular weight in the range 50,000 to 150,000, a shear stability of about 10 or less, and a Brookfield viscosity at −40° C. of between about 10,000 to 30,000 cP, as determined for a mixture of said poly alkyl (meth) acrylate in the aforesaid hydroprocessed mineral oil wherein the poly alkyl (meth) acrylate is present in said oil in an amount sufficient to achieve an equivalent fresh oil kinematic viscosity of about 7 to 8 $mm^2/s$ at 100° C., the total amount of said first and second poly alkyl (meth) acrylate viscosity index improver in the fluid and the amount of the first poly alkyl (meth) acrylate present in the poly alkyl (meth) acrylate mixture being as presented in FIG. 1*a*.

8. The method of claim 7 wherein the total amount of said first and second poly alkyl (meth) acrylate) viscosity index improvers in the fluid and the amount of the first poly alkyl (meth) acrylate viscosity index improver present in the said mixture of poly alkyl (meth) acrylates is as presented in FIG. 1*b*.

9. The method of claim 7 wherein the total amount of said first and second poly alkyl (meth) acrylate viscosity index improver in the fluid and the amount of the first poly alkyl (meth) acrylate viscosity index improver present in said mixture of poly alkyl (meth) acrylates is as presented in FIG. 1*c*.

10. The method of claim 7, 8 or 9 wherein the first poly alkyl (meth) acrylate viscosity index improver has a weight average molecular weight of about 150,000 to 200,000, a shear stability index of about 8 or less, and a Brookfield viscosity of about 275,000 to 475,000 cP @ −40° C.

11. The method of claim 7, 8 or 9 wherein the second poly alkyl (meth) acrylate viscosity index improver has a weight average molecular weight of about 75,000 to 125,000, a shear stability index of about 5 or less, and a Brookfield viscosity of about 12,000 to 25,000 cP at −40° C.

12. The method of claim 11 wherein the second poly alkyl (meth) acrylate viscosity index improper has a weight average molecular weight of about 75,000 to 125,000, a shear stability index of about 5 or less, and a Brookfield viscosity of about 12,000 to 25,000 cP at −40° C.

* * * * *

UNITED STATES PATENT AND TRADEMARK OFFICE

CERTIFICATE OF CORRECTION

PATENT NO. : 5,807,815
DATED : September 15, 1998
INVENTOR(S) : Albert Gordon Alexander It is certified that error appears in the above-identified patent and that said Letters Patent is hereby corrected as shown below:

In the claims:

Claim 1, line 30, delete "at 100°C", insert --at 40°C-- .

Claim 7, line 39, delete "at 100°C", insert --at 40°C-- .

Signed and Sealed this

Thirty-first Day of August, 1999

*Attest:*

Q. TODD DICKINSON

*Attesting Officer*

*Acting Commissioner of Patents and Trademarks*